US007872361B2

(12) United States Patent
McFadden

(10) Patent No.: US 7,872,361 B2
(45) Date of Patent: Jan. 18, 2011

(54) VEHICLE INTEGRATED DEAD BATTERY BACKUP STARTING SYSTEM

(75) Inventor: Jeffrey Noel McFadden, 9330 Corwin Ct., Elk Grove, CA (US) 95758

(73) Assignee: Jeffrey Noel McFadden, Flagstaff, AZ (US)

( * ) Notice: Subject to any disclaimer, the term of this patent is extended or adjusted under 35 U.S.C. 154(b) by 435 days.

(21) Appl. No.: 12/077,908

(22) Filed: Mar. 24, 2008

(65) Prior Publication Data

US 2009/0236859 A1 Sep. 24, 2009

(51) Int. Cl.
*G08B 13/08* (2006.01)

(52) U.S. Cl. ..... 290/1 R; 290/1 A; 290/1 E

(58) Field of Classification Search ..... 290/1 R, 290/1 A, 1 E

See application file for complete search history.

(56) References Cited

U.S. PATENT DOCUMENTS 5,880,532 A 3/1999 Stopher
5,932,943 A 8/1999 Werner et al.
5,998,961 A * 12/1999 Brown ..... 290/1 A
6,249,106 B1 * 6/2001 Turner et al. ..... 320/136
6,362,595 B1 * 3/2002 Burke ..... 320/104
6,362,599 B1 * 3/2002 Turner et al. ..... 320/135
6,556,867 B1 4/2003 Kohls
6,646,845 B1 * 11/2003 Turner et al. ..... 361/86
7,319,306 B1 * 1/2008 Rydman et al. ..... 320/166
2001/0025618 A1 * 10/2001 Kelling ..... 123/179.28
2008/0072859 A1 * 3/2008 Esaka et al. ..... 123/179.3
2008/0116844 A1 * 5/2008 Dabush et al. ..... 320/104

FOREIGN PATENT DOCUMENTS

JP 200075372 * 6/2000

* cited by examiner

*Primary Examiner*—Tho D Ta

(57) ABSTRACT

A system to a provide a power supply that converts mechanical energy stored in a structure (such as a coil, spiral, or gas spring), to electrical energy to power a vehicle starter motor. After a motorist inputs mechanical energy into the structure (e.g., stresses or winds the spring or compresses a gas), the mechanical energy is released to exert, preferably through a coupled gear mechanism, mechanical energy on a device (such as a generator, dynamo, alternator, or other electrical generating device) that converts the mechanical energy into electrical energy. Such a feature allows for electrical energy to be available to power a vehicle starter motor and thus start a vehicle's engine even when the normal battery is weak or dead.

11 Claims, 4 Drawing Sheets

VEHICLE INTEGRATED DEAD BATTERY BACKUP STARTING SYSTEM

RELATED APPLICATIONS

The present application is related to U.S. Pat. No. 5,880,532, issued Mar. 9, 1999, for WIND-UP POWER SOURCE WITH SPRING MOTOR AND VEHICLE INCORPORATING SAME, by Stopher, included by reference herein.

The present application is related to U.S. Pat. No. 5,932,943, issued Aug. 3, 1999, for BICYCLE DYNAMO HAVING A ROTARY-CURRENT GENERATOR, by Werner, et al., included by reference herein.

The present application is related to U.S. Pat. No. 6,556,867, issued Apr. 29, 2003, for APPARATUS AND METHOD TO POWER A MEDICAL DEVICE USING STORED MECHANICAL POWER, by Kohls, included by reference herein.

FIELD OF THE INVENTION

The present invention relates to motor vehicles and, more particularly, to the engine start-up system.

BACKGROUND OF THE INVENTION

At times, a motor vehicle such as a car, truck or sport utility vehicle will have a dead battery preventing normal starting of the engine. This can leave a motorist in a dangerous situation, such as in a high-crime neighborhood, by the side of the roadway, in a lonely parking lot at night, outside in the wind, rain, snow and cold, or, at the very least, greatly inconvenienced in their own driveway.

The current method to solve this problem is to approach a stranger and use jumper cables or call a friend, relative, or tow truck service.

In order to jump start a vehicle with jumper cables, first, another vehicle must be located and be available. Second, the owner must be approached and talked into stopping to offer help. This leaves the person with a dead battery at the complete mercy of a total stranger and in a vulnerable, exposed state. The other solution is to call an auto service club and wait for the tow truck service to arrive while paying the expense. My invention overcomes all the short-comings of the current solutions by allowing a motor vehicle to be started even with a dead battery on the spot, without even having to exit the vehicle.

It would be advantageous to provide a means to start a vehicle with a dead battery.

It would also be advantageous to provide a means to start a vehicle with a dead battery that would not rely on strangers or costly road services.

It would further be advantageous to provide a means which would allow for starting of the vehicle without having to exit the vehicle.

SUMMARY OF THE INVENTION

In accordance with the present invention, there is provided a system to start a motor vehicle with a dead battery without having to get out of the vehicle. Mounted in the dashboard or another place within reach of a person seated in the driver seat, is a hand cranked mechanical input device connected under the hood, or other place integrated into the vehicle, to a gear and spring assembly, also referred to as a spring drive transmission. Within said assembly is a coiled, mechanical energy tension storage device, commonly called a spiral spring, similar to a wrist-watch or clock drive spring. The spiral spring is coupled to (a) rotary drive device(s), commonly called (a) gear(s). The preferred embodiment of the rotational drive devices are what are commonly called gears, but may also include, but is not limited to what is commonly called cog wheels, sprockets, belts and pulleys, and the like. As the hand crank is rotated from within the passenger compartment, it winds the spring, storing up sufficient energy that will be released to drive the gear assembly. The gear assembly is comprised of one or more gears to power an electrical current generation device, commonly called a generator. When the spiral spring is fully wound, it will lock in place to store energy to be released at the release of a release mechanism. The hand crank/handle must first be removed to activate a means which will unlock the safety catch mechanism. This is so the hand crank does not spin around and injure the user when the release mechanism is activated. When the release is activated it unleashes the spiral spring which in turn drives ratioed gears. The purpose of ratioed gears is to generate sufficient spin to the generator and thus, sufficient electrical current from the generator which is separate from the vehicle's regular alternator. As this spring driven gear assembly, also referred to as the spring drive transmission, drives the generator, the generator spins quickly enough to generate a sufficient electrical charge to start the vehicle's starter motor. When the generator is under spring power, which lasts for several moments or so, a "start light" is illuminated in the passenger compartment within view of the driver, perhaps in the instrument panel or near the hand crank base. Placement of the "turn ignition key light", or "start" light will depend on the ergonomics of each individual vehicle make, model, and design. When the driver sees the start light illuminate, this signals the motorist that there is sufficient electricity being generated to power the starter motor and the ignition key must be quickly turned before the drive spring finishes unwinding all the way. During these few moments as the spiral spring powers the generator through the drive gear assembly, there is equal electrical charge being generated as would be from a working battery.

The system works for any type of engine whether it is gasoline, diesel, ethanol, electric, hybrid, hydrogen fuel cell, or any other type engine, as well as automotive, truck, sport utility vehicles, boat and marine, airplane or any other type applications.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
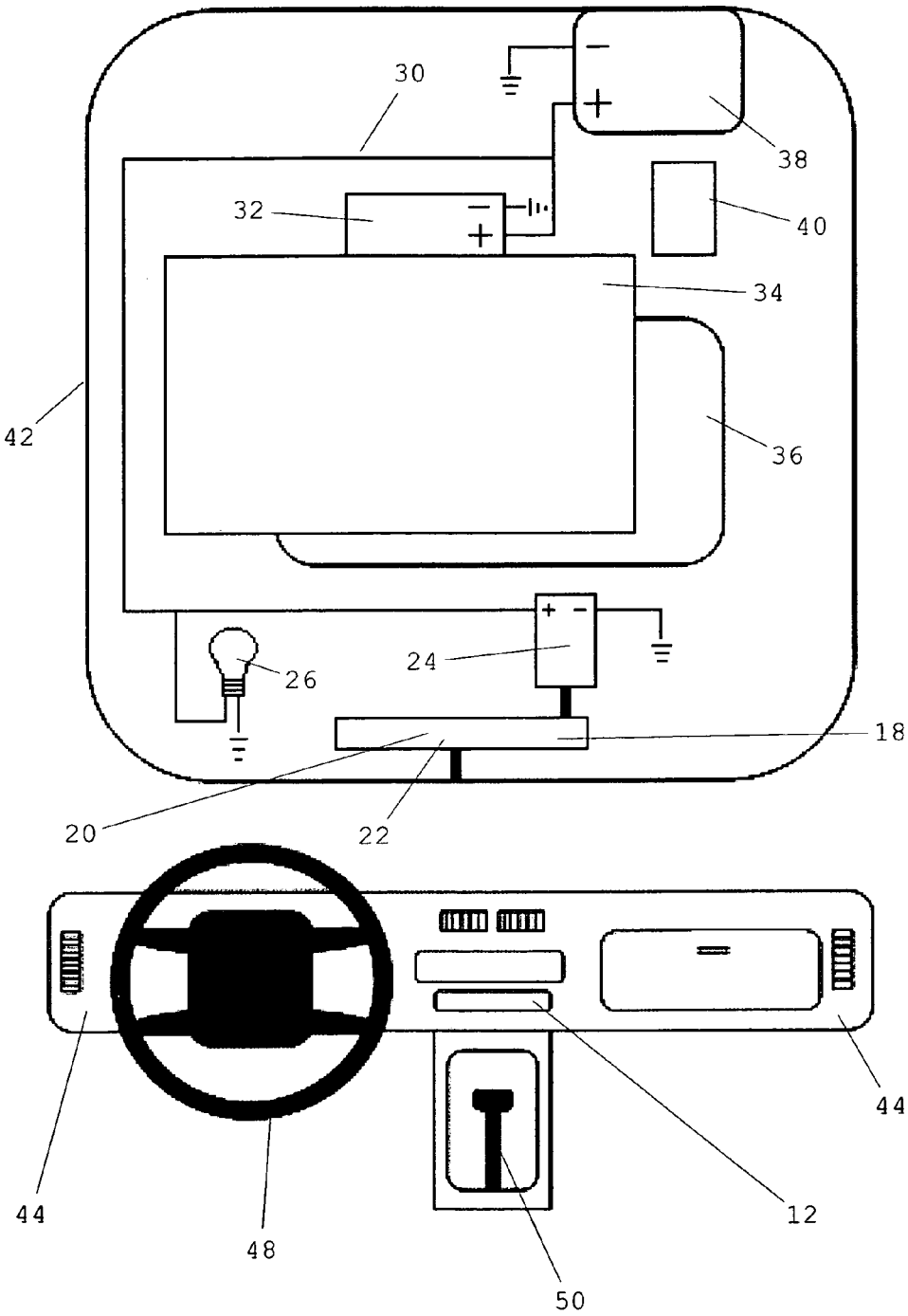
FIG. 1 is a top plan view of a complete back-up starting system overview. the top square represents the engine compartment and some of its typical associated components. the lower portion of the illustration represents the dashboard inside the passenger compartment.

Vehicle Integrated Dead Battery 38 Backup Starting System includes a mechanical input device (such as a hand crank), a stored mechanical energy device 18 (such as a spiral spring), a stored mechanical energy device driven transmission/drive gear assembly 20, (such as a gear assembly) and a generator 24. Hand crank/mechanical input device 14 is removably connected to mechanical energy storage device, which is coupled to generator 24, preferably through coupled drive gear assembly. The input of mechanical power into mechanical energy storage device using mechanical input device can take a variety of embodiments. In an exemplary embodiment, a hand operated crank is used to stress a spring. As the spring unwinds, generator 24 is driven to provide a source of electrical energy for the starter motor 32. The hand operated crank preferably includes a removable or retractable crank with a handle (so during unwinding of the stored mechanical energy device 18 the handle will not whip around and cause possible injury to the user).

An electrical current generation device, commonly called a Generator 24, is conventional for use in automotive applications and therefore all possible embodiments are not described in detail. Generally, a generator 24 includes a rotor and a stator. The rotor includes one or more magnets, and the stator includes a plurality of coil windings and substantially surrounds the rotor. In operation, coupled drive gear mechanism driven by stored mechanical energy device 18 rotates the rotor relative to the stator using power supplied by device. As the rotor rotates, the mechanical energy is converted to electrical energy.

When stored mechanical energy device 18 transmits mechanical energy to generator 24, the generator 24 converts the mechanical energy into electrical energy. Stored mechanical energy device 18, coupled drive mechanism, and generator 24 may be integrated together into a single arrangement, as conventionally known and available in the mechanical/electrical arts. In an exemplary embodiment, the generator 24 assembly includes a spring, wherein the operator stresses and releases the spring by compressing it and allowing it to decompress or unwind. The decompressing spring actuates a coupled gear mechanism, which is coupled to the generator 24. The generator 24 converts the rotation of the coupled gear mechanism to electrical energy. The spring may be any of a variety of spring types, including a spiral spring, a coil spring, a gas, or the like.

One embodiment of a generator 24 assembly, a spiral spring drive, includes a spiral spring coupled to the shaft of a generator 24, a coupled mechanism connected to the shaft, and the generator 24. In the spiral spring drive embodiment, mechanical energy is stored in the spiral spring by rotating a shaft (e.g., by a crank, knob, or the like) coupled to the spiral spring. A stop pin may be included on the shaft to prevent overrotation of the spiral spring. When the stressed, spiral spring is released, and allowed to return to its unstressed state, the coupled mechanism is operably engaged. Though the shaft may be coupled directly to the generator 24, the coupled mechanism may be comprised of one or more gears for maximum mechanical advantage and efficiency. In an exemplary embodiment, the generator 24 may include a flywheel operably coupled to the coupled drive. Thus, rotation of the flywheel rotates the rotor, thus electric energy is produced.

In another possible embodiment of a generator 24 assembly, a gas spring drive, the mechanical energy is stored is a chamber when a gas (such as air) is compressed by a pump actuator, foot pedal, lever, handle, crank, or the like. When the compressed gas is released, the coupled mechanism is actuated to drive the generator 24.

In yet another possible embodiment, a hand crank or hand pull-cord is used to provide rotational mechanical energy to generator 24. As the hand crank or hand pull-cord is pulled, it rotates a flywheel coupled to the generator 24. The hand operated crank is preferred because a hand driven mechanism tends to be more reliable.

FIG. 1 is a top plan view of a complete back-up starting system. The top square represents the engine compartment 42 and some of its typical associated components. The lower portion of the illustration represents the dashboard 44 inside the passenger compartment. The engine compartment 42 would include such standard or conventional components such as an engine 34, transmission 36, alternator 40, battery 38, starter motor 32 and their associated electrical cables 30. The vehicle interior and dashboard 44 includes typical components such as steering wheel 48, transmission shift lever 50, glove box 52, etc. A one-way winding lock mechanism 22 may be integrated into the stored mechanical energy device 18 and stored mechanical energy device driven transmission/drive gear assembly 20. As the hand crank/mechanical input device 14 is rotated, a one-way ratcheting lock mechanism 22 may prevent premature unwinding of the stored mechanical energy device 18.

Figure 2:
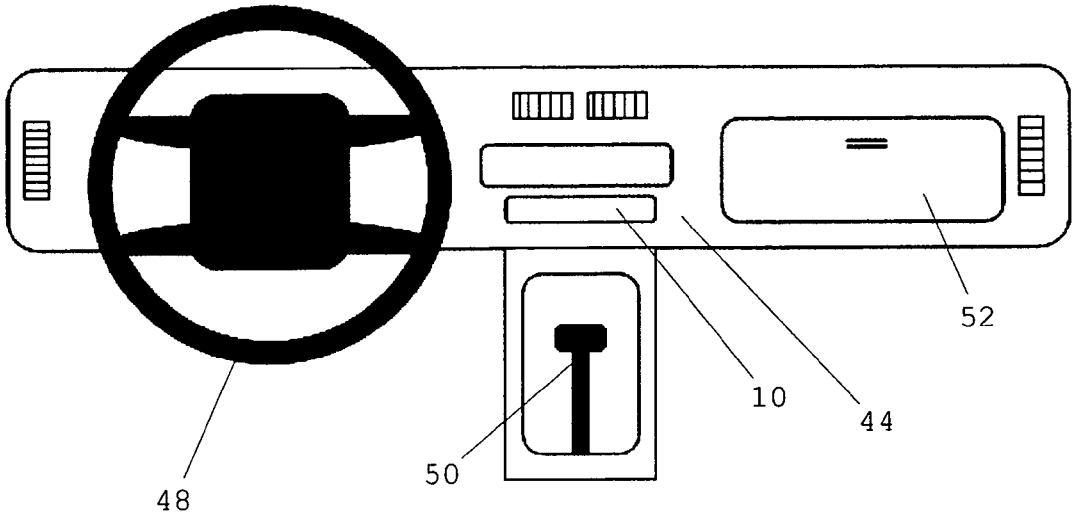
FIG. 2 is a front view of a dashboard with the hand crank/handle compartment door closed.

FIG. 2 is a front view of a dashboard 44 with the hand crank compartment 10 closed.

Figure 3:
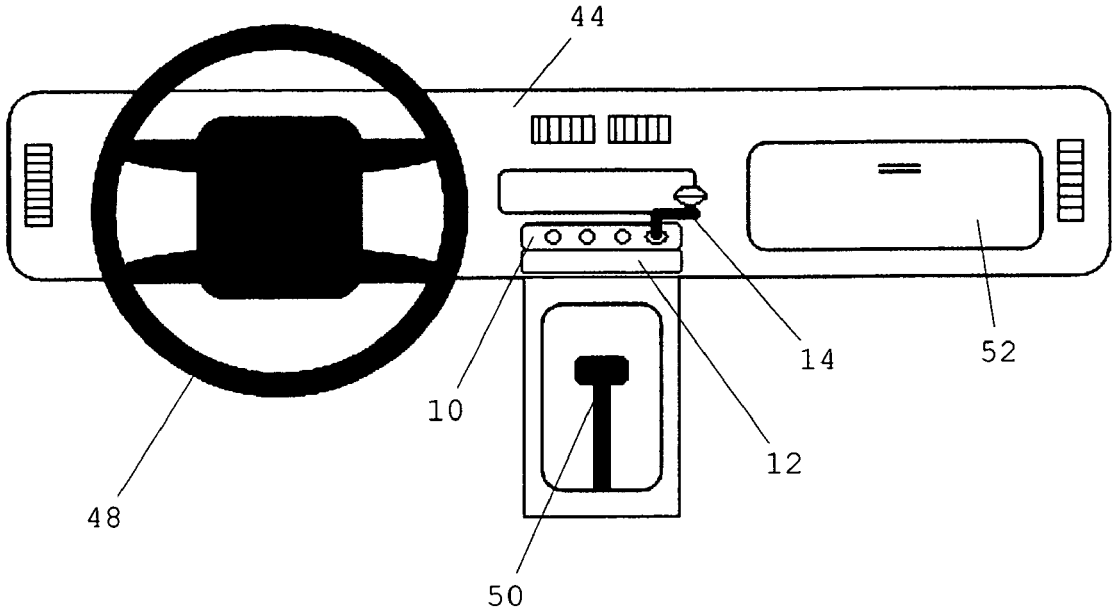
FIG. 3 is a front view of a dashboard with the hand crank/handle compartment door open and hand crank/handle inserted.

FIG. 3 is a front view of a dashboard 44 with the hand crank compartment 10 open and hand crank/mechanical input device 14 inserted. The hand crank compartment door 12 is flipped open.

Figure 4:
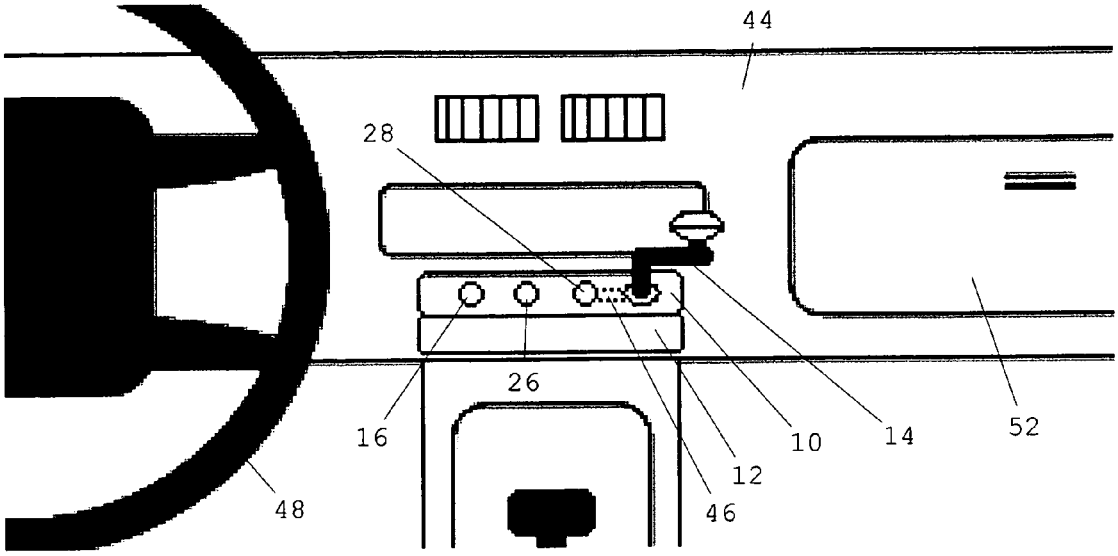
FIG. 4 is a front partial view of a dashboard with the hand crank/handle compartment door open and hand crank inserted viewed closer up.

FIG. 4 is a partial front view of a dashboard 44 with the hand crank compartment 10 open and hand crank inserted viewed closer up. Within easy access of the driver may be a cutover switch 16 to cut in the back-up starting system when the normal starting system battery 38 has failed. Before the hand crank is installed, a safety catch/release 46 may be engaged to allow the hand crank to be inserted which simultaneously prevents the use of the release mechanism 28 while the hand crank is installed. When the hand crank is removed after winding is complete, the coupled safety catch/release 46 mechanism allows the release mechanism 28 to become operable. While the stored mechanical energy device 18 powers the generator 24 and an electrical current is being generated the on light 26, mounted in an easily viewable position, illuminates and signals the motorist to turn the ignition key.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A vehicle integrated dead battery backup starting system for starting a motor vehicle engine with a dead battery, comprising:

means for inputting energy;

means for cutting in the back-up starting system when a normal starting system battery fails;

means for storing sufficient mechanical energy removably connected to said means for inputting energy;

means for diverting a stored mechanical energy in said means for storing sufficient mechanical energy, driveably coupled to said means for storing sufficient mechanical energy;

means for locking said means for storing sufficient mechanical energy and a gear assembly in a locked position to hold it until said means for inputting energy is removed and a means for releasing said means for storing sufficient mechanical energy is actuated, lockably connected to said means for diverting the stored mechanical energy;

means for generating sufficient electricity to power a starter motor, operably coupled to said means for diverting the stored mechanical energy, and switchably connected to said means for cutting in the back-up starting system when the normal starting system battery fails;

means for signaling a user that sufficient electricity is being generated in order to power the starter motor and an ignition key must be turned quickly before said means for storing sufficient mechanical energy exhausts its release of energy, electrically connected to said means for generating sufficient electricity to power the starter motor;

said means for releasing said means for storing sufficient mechanical energy, lockingly connected to said means for locking; and means for allowing said means for inputting energy to be installed while simultaneously preventing activation of said means for releasing said means for storing sufficient mechanical energy.

2. The vehicle integrated dead battery backup starting system in accordance with claim 1, wherein said means for inputting energy comprises a hand crank/mechanical input device for inputting energy to said means for storing sufficient mechanical energy.

3. The vehicle integrated dead battery backup starting system in accordance with claim 1, wherein said means for cutting in the back-up starting system when the normal starting system battery fails comprises a cutover switch.

4. The vehicle integrated dead battery backup starting system in accordance with claim 1, wherein said means for storing sufficient mechanical energy comprises a stored mechanical energy device for storing sufficient mechanical energy to said means for generating sufficient electricity to power a starter motor.

5. The vehicle integrated dead battery backup starting system in accordance with claim 1, wherein said means for diverting the stored mechanical energy comprises a stored mechanical energy device driven transmission/drive gear assembly for diverting the stored mechanical energy in said means for storing sufficient mechanical energy to said means for generating sufficient electricity to power a starter motor.

6. The vehicle integrated dead battery backup starting system in accordance with claim 1, wherein said means for locking comprises a lock mechanism.

7. The vehicle integrated dead battery backup starting system in accordance with claim 1, wherein said means for generating sufficient electricity to power the starter motor comprises a generator.

8. The vehicle integrated dead battery backup starting system in accordance with claim 1, wherein said means for signaling the user comprises an on light.

9. The vehicle integrated dead battery backup starting system in accordance with claim 1, wherein said means for releasing said means for storing sufficient mechanical energy comprises a release mechanism.

10. The vehicle integrated dead battery backup starting system in accordance with claim 1, wherein said means for allowing comprises a safety catch/release.

11. A vehicle integrated dead battery backup starting system for starting a motor vehicle engine with a dead battery, comprising:

a hand crank/mechanical input device, for inputting energy to a stored mechanical energy device;

a cutover switch, for cutting in the back-up starting system when the normal starting system battery fails;

a stored mechanical energy device, for storing sufficient mechanical energy to power a generator, removably connected to said hand crank/mechanical input device;

a stored mechanical energy device driven transmission/drive gear assembly, for diverting the stored mechanical energy in the stored mechanical energy device to the generator, driveably coupled to said stored mechanical energy device;

a lock mechanism, for locking the stored mechanical energy device and a gear assembly in a locked position to hold it until the hand crank is removed and a release mechanism is actuated, lockably connected to said stored mechanical energy device driven transmission/drive gear assembly;

said generator, for generating sufficient electricity to power the starter motor, operably coupled to said stored mechanical energy device driven transmission/drive gear assembly, and switchably connected to said cutover switch;

an on light, for signaling a user that sufficient electricity is being generated in order to power a starter motor and an ignition key must be turned quickly before the stored mechanical energy device exhausts its release of energy, electrically connected to said generator;

said release mechanism, for releasing the stored mechanical energy device, lockingly connected to said lock mechanism; and a safety catch/release, for allowing the hand crank to be installed while simultaneously preventing activation of the release mechanism.

* * * * *